US007830323B2

(12) United States Patent
Tsujimura et al.

(10) Patent No.: US 7,830,323 B2
(45) Date of Patent: Nov. 9, 2010

(54) ANTENNA DEVICE AND WIRELESS MOBILE TERMINAL PROVIDED WITH MAGNETIC MATERIAL

(75) Inventors: Akihiro Tsujimura, Tokyo (JP); Koichi Sato, Tokyo (JP); Takashi Amano, Saitama-ken (JP); Satoshi Mizoguchi, Tokyo (JP); Isao Ohba, Tokyo (JP)

(73) Assignee: Kabushiki Kaisha TOSHIBA, Tokyo (JP)

( * ) Notice: Subject to any disclaimer, the term of this patent is extended or adjusted under 35 U.S.C. 154(b) by 261 days.

(21) Appl. No.: 11/974,630

(22) Filed: Oct. 15, 2007

(65) Prior Publication Data

US 2008/0191954 A1 Aug. 14, 2008

(30) Foreign Application Priority Data

Feb. 13, 2007 (JP) ..... 2007-032410

(51) Int. Cl.
*H01Q 1/00* (2006.01)

(52) U.S. Cl. ..... 343/787

(58) Field of Classification Search ..... 343/787, 343/702, 700 MS, 872
See application file for complete search history.

(56) References Cited

U.S. PATENT DOCUMENTS 5,502,452 A * 3/1996 Gomez ..... 343/715
7,573,426 B2 * 8/2009 Amano et al. ..... 343/702
2005/0057406 A1 * 3/2005 Ohara et al. ..... 343/702
2006/0164317 A1 * 7/2006 Hughes ..... 343/841
2008/0252536 A1 * 10/2008 Anguera et al. ..... 343/702

FOREIGN PATENT DOCUMENTS

JP 2001-156484 A 6/2001
JP 2003-198412 A 7/2003
JP 2004-104502 A 4/2004

OTHER PUBLICATIONS http://www.windows.ucar.edu/tour/link=/physical_science/magnetism/magnetic_materials.html (dated 1997).*
http:/www.sigmaaldrich.com/materials-science/alternative-energy-materials/tutorial/...*

* cited by examiner

*Primary Examiner*—Huedung Mancuso
(74) *Attorney, Agent, or Firm*—Holtz, Holtz, Goodman & Chick, PC

(57) ABSTRACT

An antenna device is provided. The antenna device includes an antenna element including a first portion and a second portion formed almost parallel to each other, and a plane-shaped piece of magnetic material provided between the first portion and the second portion, the magnetic material arranged almost parallel to the first portion and the second portion. A wireless mobile terminal is provided. The wireless mobile terminal includes a printed circuit board, an antenna element including a first portion and a second portion formed almost parallel to each other, the first portion and the second portion arranged almost parallel to the printed circuit board each, and a plane-shaped piece of magnetic material provided between the first portion and the second portion, the magnetic material arranged almost parallel to the printed circuit board, the magnetic material arranged almost parallel to the first portion and the second portion.

22 Claims, 7 Drawing Sheets

ANTENNA DEVICE AND WIRELESS MOBILE TERMINAL PROVIDED WITH MAGNETIC MATERIAL

CROSS REFERENCE TO RELATED APPLICATIONS

This application is based upon and claims the benefit of priority from the prior Japanese Patent Application No. 2007-032410 filed on Feb. 13, 2007;

the entire contents of which are incorporated herein by reference.

FIELD OF THE INVENTION

The present invention relates to an antenna device and a wireless mobile terminal, and in particular to those provided with magnetic material.

DESCRIPTION OF THE BACKGROUND

As mounting space is limited in a small sized wireless mobile terminal, interference caused by electromagnetic coupling or capacitive coupling among an antenna and each portion of a circuit of the wireless mobile terminal may cause problems. In particular, the antenna may suffer from a reduction of radiation efficiency. For those problems, possible solutions of related art using magnetic material have been proposed as described hereafter.

A first possible solution is disclosed in Japanese Patent Publication of Unexamined Application (Kokai), No. 2001-156484, as to a mobile communication apparatus including a printed circuit board, a shield case for shielding a portion of the printed circuit board, and an antenna which may be pulled out of the shield case to be extended.

According to the above first solution, a shield effect may be improved by using two methods. One of the two methods is to strengthen electrical connections between the shield case and a ground pattern of the printed circuit board in a direction perpendicular to a direction of a radio frequency current induced on the shield case. Another one of the two methods is to layer magnetic films having an axis of easy magnetization in the direction of the radio frequency current induced on the shield case.

A second possible solution is disclosed in Japanese Patent Publication of Unexamined Application (Kokai), No. 2003-198412, as to a mobile communication apparatus including anisotropic magnetic material in a near magnetic field produced by the apparatus.

According to the above second solution, the anisotropy may be directed in a same direction as magnetic field lines forming the radio frequency magnetic field are, so that the magnetic field may be absorbed by the anisotropic magnetic material.

A third possible solution is disclosed in Japanese Patent Publication (Toroku), No. 3713476, as to a mobile communication apparatus including a built-in L-shaped antenna, a printed circuit board facing the antenna, and a plate of magnetic material that is laid on the printed circuit board.

The mobile communication apparatus of the above third solution may reduce magnetic field strength on a surface of a ground layer of the printed circuit board, may reduce induced currents and may make antenna directivity stable.

A wireless mobile terminal may include a built-in antenna of a complex shape like being folded or branched so as to meet one need for a smaller size and a thinner shape of the wireless mobile terminal and another need for multi-resonance and a broader frequency range, which tend to conflict to each other. Above wording of "built-in antenna" means an antenna provided inside a housing of the wireless mobile terminal, or an antenna unitarily formed as a portion of an inner or outer face of the housing.

The built-in antenna may suffer from a reduction of radiation efficiency due to the above complex shapes. Upon including an element folded 180 degrees, e.g., the built-in antenna may suffer from a reduction of radiation efficiency, as antenna currents distributed on both sides of a fold portion are spatially directed in reverse to each other.

Upon being of a meander type which is well known for space efficiency, the built-in antenna may suffer from a reduction of radiation efficiency, as antenna currents distributed on portions neighboring to each other are spatially directed in reverse to each other. Upon including an element that branches into two parallel portions, the built-in antenna may suffer from an impedance mismatch due to capacitive coupling between the two parallel portions.

The first solution of the related art described above is of a wireless mobile terminal having an extendable antenna. This wireless mobile terminal may be configured to have lower impedance of the shield case so that a radio frequency current may easily flow on the shield case, and that the radio frequency current may keep from being conducted into the portion shielded by the shield case.

The first solution of the related art may hardly be applied to a wireless mobile terminal including a built-in antenna, as the antenna and the printed circuit board are relatively positioned in a manner different from those of the wireless mobile terminal having the extendable antenna. The first solution of the related art may not be applied in a case where it is difficult to define the direction of the axis of easy magnetization uniquely, as the direction of the axis of easy magnetization should be defined while the magnetic films are being layered.

The second solution of the related art described above is to absorb the near magnetic field of the mobile communication apparatus (a wireless mobile terminal). In order to improve radiation efficiency of a built-in antenna of the wireless mobile terminal, it is not enough only to absorb the near magnetic field. In addition, it is necessary to emit an electromagnetic field so efficiently that the built-in antenna features a required radiation pattern and a required antenna gain. That is, the second solution of the related art alone is not enough to improve the radiation efficiency of the built-in antenna.

The third solution of the related art described above is to lay the plate of magnetic material between the built-in antenna and a ground layer of the printed circuit board so as to reduce influence of an unbalanced current induced on the ground layer. The built-in antenna, however, may not be of a simple L-shape but may be of a complex shape as described earlier. That is, although possibly contributing to a thin shape of the wireless mobile terminal, the third solution of the related art may not contribute to alleviating limited mounting space for the built-in antenna or to downsizing of a mounting area for the built-in antenna.

SUMMARY OF THE INVENTION

Accordingly, an advantage of the present invention is to provide an antenna device configured to be of a complex shape so as to be included in a small sized wireless mobile terminal, and configured to improve radiation efficiency upon being provided with magnetic material. Another advantage of the present invention is to provide a wireless mobile terminal including a built-in antenna device that may be of a complex shape, provided with magnetic material, and configured to improve radiation efficiency thereby.

To achieve the above advantage, one aspect of the present invention is to provide an antenna device including an antenna element including a first portion and a second portion formed almost parallel to each other, and a plane-shaped piece of magnetic material provided between the first portion and the second portion, the magnetic material arranged almost parallel to the first portion and the second portion.

Another aspect of the present invention is to provide a wireless mobile terminal including a printed circuit board, an antenna element including a first portion and a second portion formed almost parallel to each other, the first portion and the second portion arranged almost parallel to the printed circuit board each, and a plane-shaped piece of magnetic material provided between the first portion and the second portion, the magnetic material arranged almost parallel to the printed circuit board, the magnetic material arranged almost parallel to the first portion and the second portion.

DETAILED DESCRIPTION OF THE INVENTION

Figure 1:
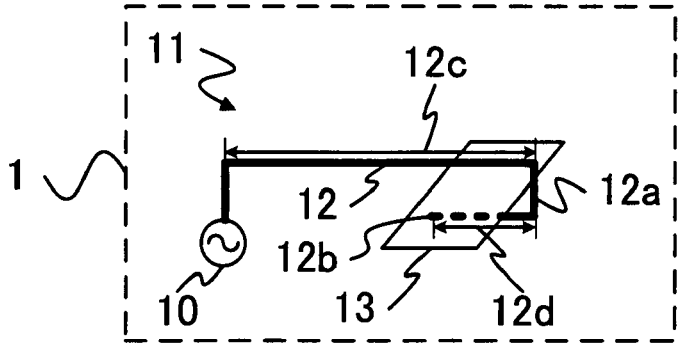
FIG. 1 shows a concept of a configuration and a shape of an antenna device of a first embodiment of the present invention.

A first embodiment of the present invention will be described with reference to FIGS. 1-4. FIG. 1 shows a concept of a configuration and a shape of an antenna device of the first embodiment. In FIG. 1, a wireless mobile terminal 1 is shown by a dashed rectangle including a feed portion 10 and an antenna device 11 of the first embodiment. The antenna device 11 has an antenna element 12 coupled to the feed portion 10.

The antenna element 12 is folded at a fold portion 12*a* about 180 degrees and downwards in FIG. 1 in order, e.g., to be adapted for limited mounting space of the wireless mobile terminal 1. The antenna element 12 has an open end 12*b*.

A portion of the antenna element 12 between one end coupled to the feed portion 10 and the fold portion 12*a* denoted by a bidirectional arrow is called a first portion 12*c*. A portion of the antenna element 12 between the fold portion 12*a* and the open end 12*b* denoted by a bidirectional arrow is called a second portion 12*d*. The first portion 12*c* and the second portion 12*d* are formed almost parallel to each other.

Between the first portion 12*c* and the second portion 12*d*, provided is a plane-shaped piece of magnetic material 13 which is included in the antenna device 11 and arranged almost parallel to the first portion 12*c* and the second portion 12*d*. In FIG. 1, a segment of the second portion 12*d* which includes the open end 12*b* and is hidden by the magnetic material 13 is shown by a dotted line.

If the antenna device 11 is activated, antenna currents distributed on the first portion 12*c* and on the second portion 12*d* are spatially directed in reverse so that a contribution to electromagnetic field radiation of the first portion 12*c* may cancel out a contribution to the electromagnetic field radiation of the second portion 12*d*.

The magnetic material 13 provided between the first portion 12*c* and the second portion 12*d* may produce an isolation effect that an electromagnetic field generated by the antenna current distributed on the first portion 12*c* and affecting the second portion 12*d* may be reduced. The magnetic material 13 may produce an isolation effect that an electromagnetic field generated by the antenna current distributed on the second portion 12*d* and affecting the first portion 12*c* may also be reduced.

As the above effect of canceling out the electromagnetic field radiation between the first portion 12*c* and the second portion 12*d* may be reduced thereby, the antenna device 11 may improve radiation efficiency.

The antenna current distributed on the first portion 12*c* has a relatively large amplitude and a relatively small amplitude near the feed portion 10 and near the fold portion 12*a*, respectively. The configuration shown in FIG. 1 where a segment of the first portion 12*c* near the feed portion 10 is provided above the open end 12*b* is thus advantageous so as to form a radiation pattern upwards in FIG. 1.

Figure 2:
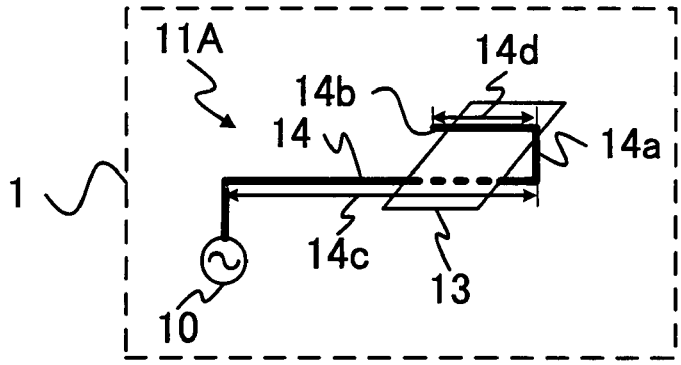
FIG. 2 shows a concept of a configuration and a shape of another antenna device of the first embodiment.

FIG. 2 shows a concept of a configuration and a shape of an antenna device 11A of the first embodiment, a modified one of the antenna device 11 shown in FIG. 1. The antenna device 11A includes an antenna element 14, and is coupled to the feed portion 10 of the wireless mobile terminal 1, which are same as the corresponding ones shown in FIG. 1. The antenna element 14 is folded at a fold portion 14*a* about 180 degrees and upwards in FIG. 2. The antenna element 14 has an open end 14*b*.

A portion of the antenna element 14 between one end coupled to the feed portion 10 and the fold portion 14*a* denoted by a bidirectional arrow is called a first portion 14*c*. A portion of the antenna element 14 between the fold portion 14*a* and the open end 14*b* denoted by a bidirectional arrow is called a second portion 14*d*. The first portion 14*c* and the second portion 14*d* are formed almost parallel to each other.

Between the first portion 14*c* and the second portion 14*d*, provided is a same as the magnetic material 13 as shown in FIG. 1. The magnetic material 13 is included in the antenna device 14 and arranged almost parallel to the first portion 14*c* and the second portion 14*d*. In FIG. 2, a middle segment of the first portion 14*c* hidden by the magnetic material 13 is shown by a dotted line.

As being different from the antenna device 11 shown in FIG. 1 only in the direction of folding of the antenna element 14 or of the antenna element 12, the antenna device 11A may produce an isolation effect of improving radiation efficiency as the antenna device 11 does by having the magnetic material 13 between the first portion 14*c* and the second portion 14*d*.

If a path length of the first portion 14*c* is longer than a path length of the second portion 14*d*, the magnetic material 13 may be arranged in such a way as to isolate the second portion 14*d* from the first portion 14*c* as shown in FIG. 2. The antenna device 14 may form a radiation pattern directed upwards in FIG. 2 without being completely blocked by the magnetic material 13, even if a segment of the first portion 14*c* near the fold portion 10 has to be placed below the open end 14*b* for mounting reasons.

Figure 3:
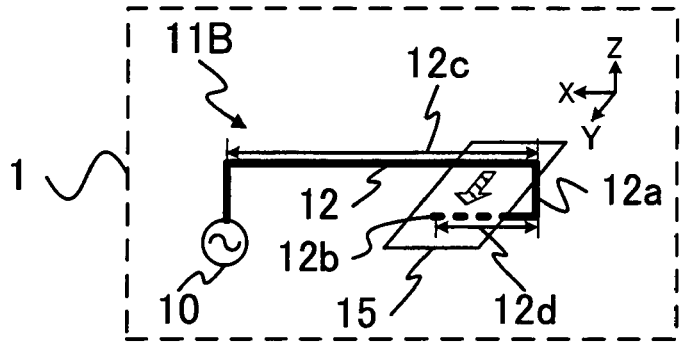
FIG. 3 shows a concept of a configuration and a shape of an antenna device of the first embodiment modified from that shown in FIG. 1.

FIG. 3 shows a concept of a configuration and a shape of an antenna device 11B of the first embodiment, modified from the antenna device 11 shown in FIG. 1 by replacing the magnetic material 13 with anisotropic magnetic material. The antenna device 11B includes the antenna element 12 coupled to the feed portion 10 of the wireless mobile terminal 1, which are same as the corresponding ones shown in FIG. 1.

Between the first portion 12*c* and the second portion 12*d*, provided is a plane-shaped piece of anisotropic magnetic material 15 which is included in the antenna device 11B and arranged almost parallel to the first portion 12*c* and the second portion 12*d*.

For convenience of explanation, an orthogonal coordinate system is defined as shown in FIG. 3. The orthogonal coordinate system has an X-axis which is almost parallel to the first portion 12*c* or the second portion 12*d* of the antenna element 12, and to a face of the anisotropic magnetic material 15.

The orthogonal coordinate system has a Y-axis which is perpendicular to the X-axis and almost parallel to the face of the anisotropic magnetic material 15. The orthogonal coordinate system has a Z-axis which is perpendicular to the X-axis and the Y-axis, and is almost perpendicular to the face of the anisotropic magnetic material 15.

The anisotropic magnetic material 15 may be made of nano-granular material or nano-columnar material. The anisotropic magnetic material 15 has a uniquely defined axis of hard magnetization. Assume that the anisotropic magnetic material 15 is arranged in such a way as to direct a axis of hard magnetization almost parallel to the Y-axis as denoted by a block arrow in FIG. 3. Assume that the anisotropic magnetic material 15 has relative magnetic permeability of a value μy in a direction of the axis of hard magnetization, i.e., parallel to the Y-axis in FIG. 3.

In the orthogonal coordinate system shown in FIG. 3, then, magnetic flux density almost relates to a magnetic field as represented by Eq. 1.

$$\begin{pmatrix} Bx \\ By \\ Bz \end{pmatrix} = \begin{pmatrix} 1 & 0 & 0 \\ 0 & \mu y & 0 \\ 0 & 0 & 1 \end{pmatrix} \begin{pmatrix} Hx \\ Hy \\ Hz \end{pmatrix} \quad \text{(Eq. 1)}$$

A left hand side of Eq. 1 represents magnetic flux density produced by a magnetic field applied to the anisotropic magnetic material 15 as a vector in the orthogonal coordinate system. A right hand side of Eq. 1 represents a product of the relative magnetic permeability of the anisotropic magnetic material 15 represented as a matrix in the orthogonal coordinate system and the magnetic field represented as a vector.

Eq. 1 represents a characteristic of anisotropic magnetic material in which intrinsic magnetic permeability works on a magnetic field component of a direction of an axis of hard magnetization, and does not work (i.e., works as magnetic permeability of free space) on a magnetic field component of another direction.

There is a fact that an upper limit value of relative magnetic permeability of general (isotropic) magnetic material decreases more in a higher frequency range, which is known as Snoek's limit. At a frequency of 1 GHz, e.g., an upper limit value of relative magnetic permeability of magnetic material such as ferrite is no greater than 10.

It is known though that anisotropic magnetic material has relative magnetic permeability of a higher value, e.g., expected to be 50 at 1 GHz, in a direction of an axis of hard magnetization. Accordingly, as shown in FIG. 3, the anisotropic magnetic material 15 may be arranged in such a way as to direct the axis of hard magnetization almost perpendicular to the first portion 12*c* and the second portion 12*d* (parallel to the Y-axis).

The anisotropic magnetic material 15 may prevent magnetic fields generated by the antenna currents distributed on the first portion 12*c* and on the second portion 12*d* more effectively from mutually affecting thereby. The antenna device 11B, consequently, may improve radiation efficiency more than the antenna device 11 does.

Figure 4:
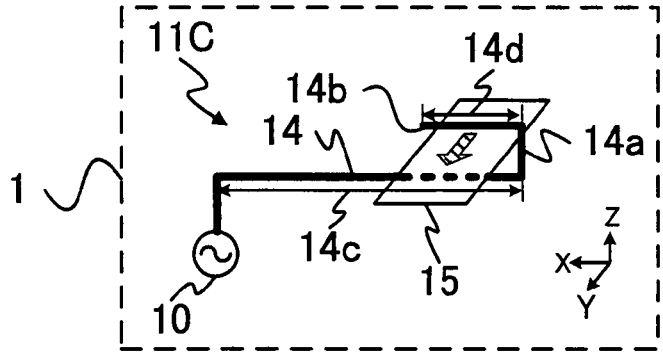
FIG. 4 shows a concept of a configuration and a shape of an antenna device of the first embodiment modified from that shown in FIG. 2.

FIG. 4 shows a concept of a configuration and a shape of an antenna device 11C of the first embodiment, modified from the antenna device 11A shown in FIG. 2 by replacing the magnetic material 13 with anisotropic magnetic material. The antenna device 11C includes the antenna element 14 coupled to the feed portion 10 of the wireless mobile terminal 1, which are same as the corresponding ones shown in FIG. 2. The antenna device 11C includes the anisotropic magnetic material 15 which is a same as the corresponding one shown in FIG. 3.

In FIG. 4, defined is a same orthogonal coordinate system as the one defined in FIG. 3, and the anisotropic magnetic material 15 is arranged in such a way as to direct the axis of hard magnetization almost parallel to the Y-axis as denoted by a block arrow in FIG. 4.

As being different from the antenna device 11B shown in FIG. 3 only in the direction of folding of the antenna element 14 or of the antenna element 12, the antenna device 11C may produce an effect of improving radiation efficiency as the antenna device 11B does by having the anisotropic magnetic material 15 between the first portion 14*c* and the second portion 14*d*.

If the path length of the first portion 14*c* is longer than the path length of the second portion 14*d*, the anisotropic magnetic material 15 may be arranged in such a way as to isolate the second portion 14*d* from the first portion 14*c* as shown in FIG. 4. The antenna device 14 may form a radiation pattern directed upwards in FIG. 4 without being completely blocked by the anisotropic magnetic material 15, even if a segment of the first portion 14*c* near the fold portion 10 has to be placed below the open end 14*b* for mounting reasons.

In FIG. 1, the first portion 12*c* and the second portion 12*d* may be plated on or stuck to an upper face and a lower face, respectively, of a layered structure including the magnetic material 13. In FIG. 3, the first portion 12*c* and the second portion 12*d* may be plated on or stuck to an upper face and a lower face, respectively, of a layered structure including the anisotropic magnetic material 15. In both cases referred to above, the fold portion 12*a* may be formed as a via hole through which the upper face and the lower face of the layered structure are electrically coupled to each other.

In FIG. 2, the first portion 14*c* and the second portion 14*d* may be plated on or stuck to a lower face and an upper face, respectively, of a layered structure including the magnetic material 13. In FIG. 4, the first portion 14*c* and the second portion 14*d* may be plated on or stuck to a lower face and an upper face, respectively, of a layered structure including the anisotropic magnetic material 15. In both cases referred to above, the fold portion 14*a* may be formed as a via hole through which the upper face and the lower face of the layered structure are electrically coupled to each other.

According to the first embodiment of the present invention described above, a wireless mobile terminal includes a built-in antenna device having an antenna element folded at a fold portion as mounting space is limited, etc., and includes a plane-shaped piece of magnetic material provided between portions of the antenna element on both sides of the fold portion, so as to prevent radiation efficiency from dropping due to antenna currents distributed on both sides of the fold portion and spatially directed in reverse to each other.

Figure 5:
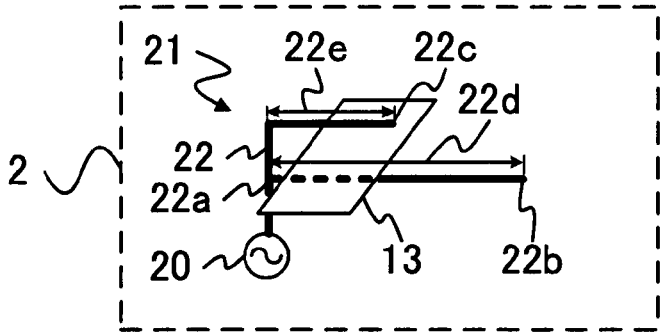
FIG. 5 shows a concept of a configuration and a shape of an antenna device of a second embodiment of the present invention.

A second embodiment of the present invention will be described with reference to FIG. 5 and FIG. 6. FIG. 5 shows a concept of a configuration and a shape of an antenna device of the second embodiment. In FIG. 5, a wireless mobile terminal 2 is shown by a dashed rectangle including a feed portion 20 and an antenna device 21 of the second embodiment having an antenna element 22 coupled to the feed portion 20.

The antenna element 22 is branched at a branch portion 22*a*, e.g., aiming at multi-resonance. One branch of the antenna element 22 ends at an open end 22*b*, and another branch of the antenna element 22 ends at an open end 22*c*.

A portion of the antenna element 22 between the branch portion 22*a* and the open end 22*b* denoted by a bidirectional arrow is called a first portion 22*d*. A portion of the antenna element 22 between the branch portion 22*a* and the open end 22*c* denoted by a bidirectional arrow is called a second portion 22*e*. The first portion 22*d* and the second portion 22*e* are formed almost parallel to each other.

Between the first portion 22*d* and the second portion 22*e*, provided is a same as the magnetic material 13 of the first embodiment. The magnetic material 13 is included in the antenna device 21 and arranged almost parallel to the first portion 22*d* and the second portion 22*e*. In FIG. 5, a middle segment of the first portion 22*d* hidden by the magnetic material 13 is shown by a dotted line.

The antenna device 21 has a resonant frequency depending on a path length between the feed portion 20 and the open end 22*b*. The antenna device 21 has another resonant frequency depending on a path length between the feed portion 20 and the open end 22*c*.

As separation between the first portion 22*d* and the second portion 22*e* decreases and capacitive coupling between those portions 22*d* and 22*e* increases, lower one of the two resonant frequencies increases. In that case, as the antenna device 21 would equivalently have a greater size, the above capacitive coupling may cause impedance of the antenna device 21 to decrease and may cause a mismatch at each of the resonant frequencies thereby.

The magnetic material 13 provided between the first portion 22*d* and the second portion 22*e* may reduce electromagnetic coupling between those portions 22*d* and 22*e*, as described with respect to the first embodiment. The above coupling reduction may apparently look like an increase of the separation between the first portion 22*d* and the second portion 22*e* in a radio frequency range covering the above resonant frequencies. The capacitive coupling between those portions 22*d* and 22*e* may decrease, and the impedance of the antenna device 21 may be kept from decreasing thereby.

Assume that a path length between the feed portion 20 and the open end 22*b* including the first portion 22*d* is longer than a path length between the feed portion 20 and the open end 22*c* including the second portion 22*e*. The first portion 22*d* and the second portion 22*e*, then, may contribute to resonance at relatively lower and higher ones of the resonant frequencies, respectively.

In that case, the magnetic material 13 may be arranged in such a way as to isolate the second portion 22*e* from the first portion 22*d* as shown in FIG. 5. The antenna device 21 may direct a radiation pattern upwards in FIG. 5 at the higher resonant frequency without difficulty thereby. Besides, the antenna device 21 may direct a radiation pattern upwards in FIG. 5 at the lower resonant frequency without being completely blocked by the magnetic material 13, as well.

Figure 6:
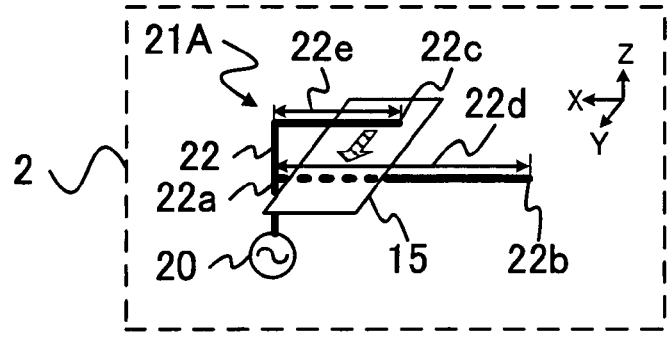
FIG. 6 shows a concept of a configuration and a shape of an antenna device of the second embodiment modified from that shown in FIG. 5.

FIG. 6 shows a concept of a configuration and a shape of an antenna device 21A of the second embodiment, modified from the antenna device 21 shown in FIG. 5 by replacing the magnetic material 13 with anisotropic magnetic material. The antenna device 21A includes the antenna element 22 coupled to the feed portion 20 of the wireless mobile terminal 2, which are same as the corresponding ones shown in FIG. 5.

Between the first portion 22*d* and the second portion 22*e*, provided is a same as the anisotropic magnetic material 15 of the first embodiment. The anisotropic magnetic material 15 is included in the antenna device 21A and arranged almost parallel to the first portion 22*d* and the second portion 22*e*.

For convenience of explanation, an orthogonal coordinate system is defined as shown in FIG. 6. The orthogonal coordinate system has an X-axis which is almost parallel to the first portion 22*d* or the second portion 22*e* of the antenna element 2, and to the face of the anisotropic magnetic material 15.

The orthogonal coordinate system has a Y-axis which is perpendicular to the X-axis and almost parallel to the face of the anisotropic magnetic material 15. The orthogonal coordinate system has a Z-axis which is perpendicular to the X-axis and the Y-axis, and is almost perpendicular to the face of the anisotropic magnetic material 15. Assume that the anisotropic magnetic material 15 is arranged in such a way as to direct the axis of hard magnetization almost parallel to the Y-axis as denoted by a block arrow in FIG. 6.

Electromagnetic coupling between the first portion 22*d* and the second portion 22*e*, which are perpendicular to the direction of the axis of hard magnetization of the anisotropic magnetic material 15 or to the Y-axis, may be further reduced in this case than in the case shown in FIG. 5 thereby, for a same reason as explained with reference to FIG. 3.

The above further coupling reduction may apparently look like a further increase of the separation between the first portion 22*d* and the second portion 22*e*. The lower resonant frequency may be kept from increasing, and the impedance of the antenna device 21 may be kept from decreasing, thereby.

According to the second embodiment of the present invention described above, a wireless mobile terminal includes a built-in antenna device having an antenna element branched at a branch portion, e.g., aiming at multi-resonance, and includes a plane-shaped piece of magnetic material provided between two portions of the antenna element after being branched. The antenna device may prevent impedance from decreasing thereby.

Figure 7:
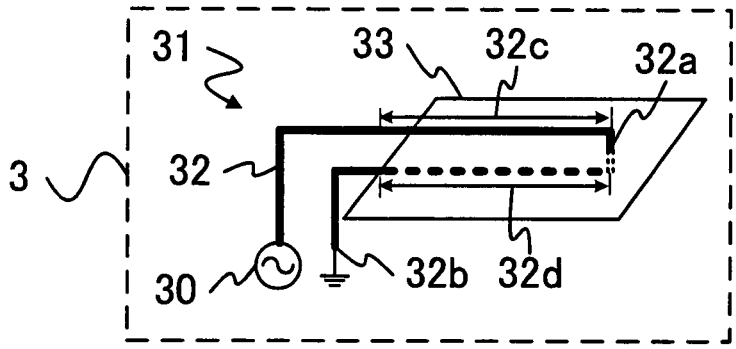
FIG. 7 shows a concept of a configuration and a shape of an antenna device of a third embodiment of the present invention.

A third embodiment of the present invention will be described with reference to FIG. 7, which shows a concept of a configuration and a shape of an antenna device of the third embodiment. In FIG. 7, a wireless mobile terminal 3 is shown by a dashed rectangle including a feed portion 30 and an antenna device 31 of the third embodiment having an antenna element 32 coupled to the feed portion 30.

The antenna element 32 is an antenna folded at a fold portion 32*a* about 180 degrees and downwards in FIG. 7, and coupled to a ground circuit of the wireless mobile terminal 3 at a grounded end 32*b*. It is known that such a folded antenna having a grounded end has a resonant frequency at which a whole length between the feed portion 30 and the grounded end 32*b* corresponds to a half wavelength.

A portion of the antenna element 32 between one end coupled to the feed portion 30 and the fold portion 32*a* denoted by a bidirectional arrow is called a first portion 32*c*. A portion of the antenna element 32 between the fold portion 32*a* and the grounded end 32*b* denoted by a bidirectional arrow is called a second portion 32*d*. The first portion 32*c* and the second portion 32*d* are formed almost parallel to each other.

Between the first portion 32*c* and the second portion 32*d*, provided is a plane-shaped piece of magnetic material 33 which is included in the antenna device 31 and arranged almost parallel to the first portion 32*c* and the second portion 32*d*. In FIG. 7, the first portion 32*c* and the second portion 32*d* may be plated on or stuck to an upper face and a lower face, respectively, of a layered structure including the magnetic material 33. In that case, the fold portion 32*a* may be formed as a via hole through which the upper face and the lower face of the layered structure are electrically coupled to each other.

In FIG. 7, the magnetic material 33 may not be spread to cover the fold portion 32*a* while as long as being arranged to isolate the first portion 32*c* from the second portion 32*d* and vice versa.

The magnetic material 33 provided between the first portion 32*c* and the second portion 32*d* may reduce capacitive coupling between those portions 32*c* and 32*d* in a radio frequency range, as described with respect to the second embodiment. A lower resonant frequency of the antenna device 31 may be kept from increasing, and the impedance of the antenna device 31 may be kept from decreasing, thereby.

The magnetic material 33 may be replaced with anisotropic magnetic material arranged in such a way that an axis of hard magnetization is almost perpendicular to the first portion 32*c* or the second portion 32*d*.

In that case, coupling between the first portion 32*c* and the second portion 32*d* may be further reduced for a same reason as explained with respect to the first embodiment or the second embodiment. The lower resonant frequency of the antenna device 31 may be kept from increasing, and the impedance of the antenna device 31 may be kept from decreasing, to a greater extent thereby.

According to the third embodiment of the present invention described above, a folded antenna element having a grounded end may prevent impedance from decreasing by including magnetic material provided between portions, being parallel to each other, on both sides of a fold portion.

Figure 8:
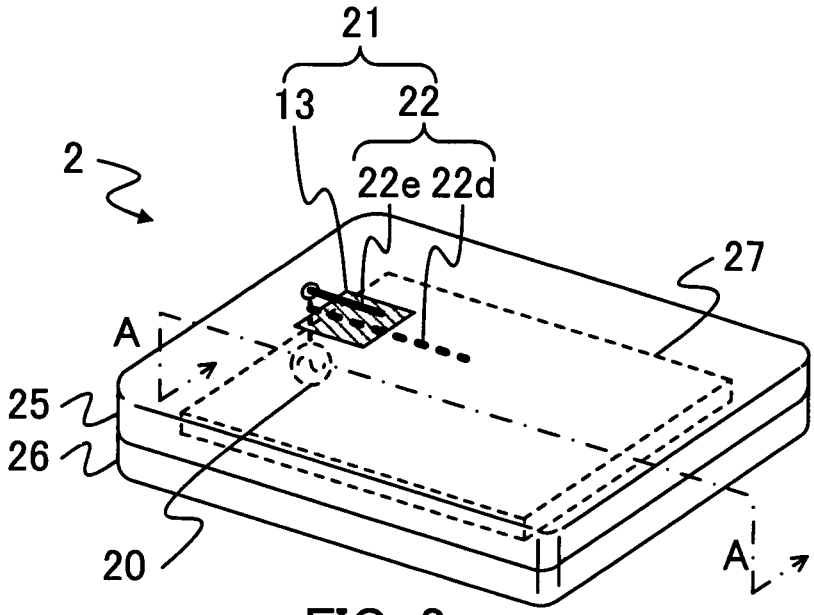
FIG. 8 shows a perspective view of a wireless mobile terminal of a fourth embodiment of the present invention.

A fourth embodiment of the present invention will be described with reference to FIGS. 8-14, where the wireless mobile terminal 2 including the antenna device 21 of the second embodiment may be configured efficiently in space as a combination of the antenna device 21, a housing and a printed circuit board. FIG. 8 shows a perspective view of a configuration of the wireless mobile terminal 2 of the fourth embodiment.

The wireless mobile terminal 2 has a housing formed by a first housing portion 25 and a second housing portion 26 mechanically connected to each other in a vertical direction as shown in FIG. 8. The wireless mobile terminal 2 has a printed circuit board 27 contained in the housing. The printed circuit board 27 includes the feed portion 20 explained as to the second embodiment.

As explained with reference to FIG. 5 of the second embodiment, the antenna element 22 coupled to the feed portion 20 has the first portion 22*d* and the second portion 22*e*. Between the first portion 22*d* and the second portion 22*e*, provided is the magnetic material 13. The antenna element 22 and the magnetic material 13 are included in the antenna device 21.

The first portion 22*d* is formed by, e.g., a metal sheet stuck to or a conductive pattern plated on an inner face (directed inside the housing) of the first housing portion 25. The second portion 22*e* is formed by, e.g., a conductive pattern plated on an outer face (directed outside the housing) of the first housing portion 25. The second portion 22*e* is coupled to the first portion 22*d* and the feed portion 20 via a connection penetrating between the outer face and the inner face of the first housing portion 25.

Figure 9:
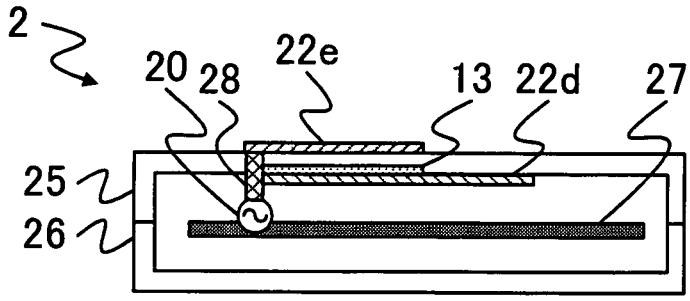
FIG. 9 shows a first cross section of the wireless mobile terminal of the fourth embodiment.

The magnetic material 13 may be provided on the inner face or the outer face of the first housing portion 25, or as an inner layer within a thickness of the first housing portion 25. How to provide the magnetic material 13 will be described with reference to FIGS. 9-11. FIG. 9 shows a first cross section of the wireless mobile terminal 2 on a plane crossing a dot-and-dash line with arrows "A-A", viewed along the arrows and almost perpendicular to a face of the printed circuit board 27, where the magnetic material 13 is provided on the inner face of the first housing portion 25.

In FIG. 9, shown is a connection 28 which penetrates between the outer face and the inner face of the first housing portion 25. The second portion 22*e* is coupled to the first portion 22*d* and the feed portion 20 through the connection 28. Each of portions shown in FIG. 9 other than the connection 28 is a same as the corresponding one given the same reference numeral in FIG. 8.

As shown in FIG. 9, the first portion 22*d* and the second portion 22*e* are provided, e.g., by being plated on the inner face and on the outer face, respectively, of the first housing portion 25. The magnetic material 13 is provided as a layer between the inner face of the first housing portion 25 and the first portion 22*d*.

Figure 10:
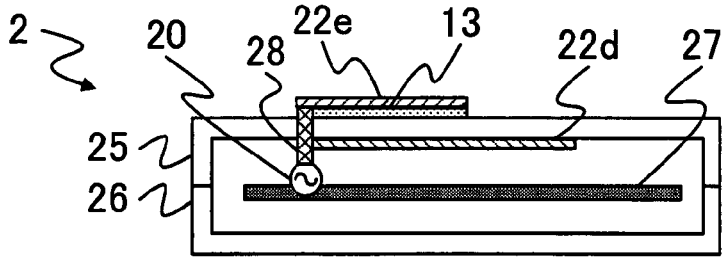
FIG. 10 shows a second cross section of the wireless mobile terminal of the fourth embodiment.

FIG. 10 shows a second cross section of the wireless mobile terminal 2 in a manner similar to FIG. 9, where the magnetic material 13 is provided on the outer face of the first housing portion 25. Each of portions shown in FIG. 10 is a same as the corresponding one given the same reference numeral in FIG. 9.

As shown in FIG. 10, the first portion 22*d* is provided, e.g., by being plated on the inner face of the first housing portion 25. The magnetic material 13 is provided on the outer face of the first housing portion 25. The second portion 22*e* is provided, e.g., by being plated on the magnetic material 13. The magnetic material 13 is thus provided as a layer between the outer face of the first housing portion 25 and the second portion 22*e*.

Figure 11:
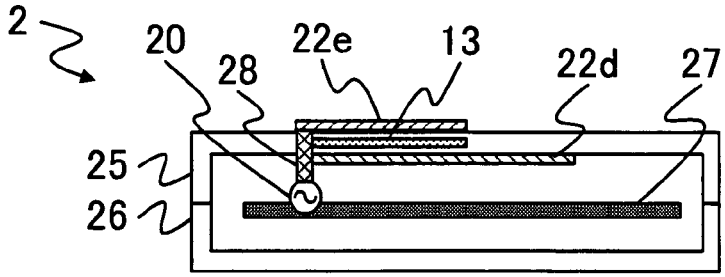
FIG. 11 shows a third cross section of the wireless mobile terminal of the fourth embodiment.

FIG. 11 shows a third cross section of the wireless mobile terminal 2 in a manner similar to FIG. 9, where the magnetic material 13 is provided as an inner layer within a thickness of the first housing portion 25. Each of portions shown in FIG. 11 is a same as the corresponding one given the same reference numeral in FIG. 9.

As shown in FIG. 11, the first portion 22*d* and the second portion 22*e* are provided, e.g., by being plated on the inner face and on the outer face, respectively, of the first housing portion 25. The magnetic material 13 is provided as the inner layer within the thickness of the first housing portion 25.

Figure 12:
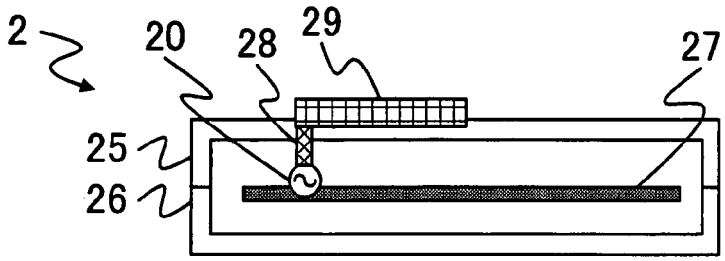
FIG. 12 shows a fourth cross section of the wireless mobile terminal of the fourth embodiment.

FIG. 12 shows a fourth cross section of the wireless mobile terminal 2 in a manner similar to FIG. 9, where an antenna component 29 unitarily formed by the first portion 22*d*, the second portion 22*e* and the magnetic material 13 is provided on the outer face of the first housing portion 25. Each of portions shown in FIG. 12 other than the antenna component 29 is a same as the corresponding one given the same reference numeral in FIG. 9 or FIG. 10.

Figure 13:
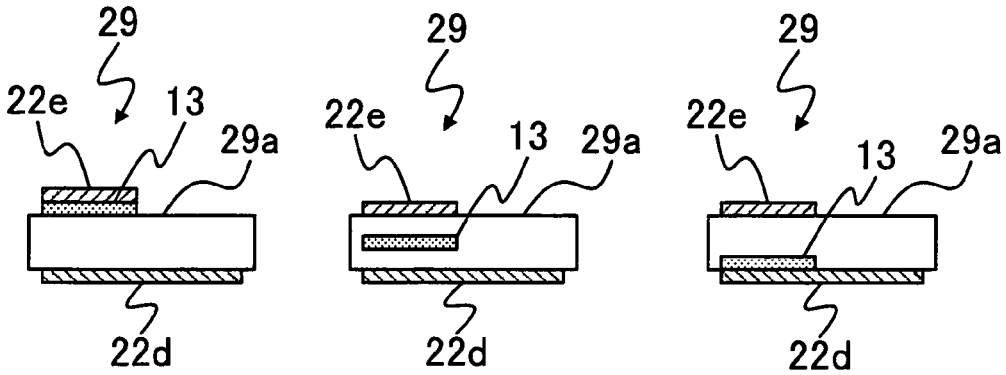
FIG. 13 shows cross sections of an antenna component of the fourth embodiment.

FIG. 13 is a cross section of the antenna component 29 showing its configuration. As shown on a left hand side of FIG. 13, the antenna component 29 may be formed by a plate-like piece of dielectric material 29*a* on which the magnetic material 13 and the second portion 22*e* are layered upside, and below which the first portion 22*d* is layered downside.

As shown in a middle of FIG. 13, the antenna component 29 may be formed by the plate-like dielectric material 29*a* on which the second portion 22*e* is layered upside, and below which the first portion 22*d* is layered downside. Within a thickness of the plate-like dielectric material 29*a*, the magnetic material 13 is provided as an inner layer, As shown on a right hand side of FIG. 13, the antenna component 29 may be formed by the plate-like shaped dielectric material 29*a* on the upper face of which the second portion 22*e* is layered, and on the lower face of which the magnetic material 13 and the first portion 22*d* are layered.

Upon being provided, as shown in FIG. 12, on the outer face of the first housing portion 25 with the antenna component 29 formed as shown by one of the figures of FIG. 13, the wireless mobile terminal 2 may be configured equivalently to that shown in one of FIGS. 9-11.

Figure 14:
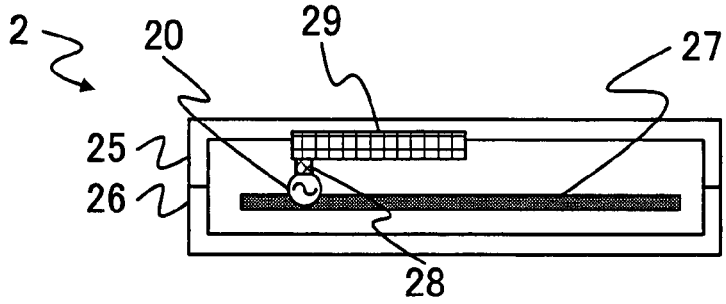
FIG. 14 shows a fifth cross section of the wireless mobile terminal of the fourth embodiment.

FIG. 14 shows a fifth cross section of the wireless mobile terminal 2 in a manner similar to FIG. 9, where the antenna component 29 is provided on the inner face of the first housing portion 25. Upon being provided with the antenna component 29 as shown in FIG. 14, the wireless mobile terminal 2 may be configured equivalently to that shown in one of FIGS. 9-11.

The cross sections of the wireless mobile terminal 2 shown in FIG. 9, etc., indicate that the wireless mobile terminal 2 is expected to direct a radiation pattern of the antenna device 21 upwards in each of the cross sections, as explained with respect to the second embodiment. The first portion 22*d* and the second portion 22*e* contribute to resonance at relatively lower and higher resonant frequencies, respectively.

As shown in each of the cross sections, the magnetic material 13 may be arranged in such a way as to isolate the second portion 22*e* from the first portion 22*d*. The wireless mobile terminal 2 may direct a radiation pattern upwards at the lower resonant frequency without being completely blocked by the magnetic material 13.

For the wireless mobile terminal 2 of the fourth embodiment described above, the magnetic material 13 may be replaced with the anisotropic magnetic material 15 as explained with respect to the second embodiment. The anisotropic magnetic material 15 may be arranged in such a way as to direct the axis of hard magnetization almost perpendicular to the first portion 22*d* or the second portion 22*e* of the antenna element 22.

The wireless mobile terminal 1 of the first embodiment may be configured as a combination of the antenna device 11, a housing and a printed circuit board, in a manner similar to the fourth embodiment. In that case, the fold portion 12*a* or the fold portion 14*a* shown in FIGS. 1-4 may be formed as a via hole penetrating between an inner face and an outer face of a housing portion.

According to the fourth embodiment of the present invention described above, a wireless mobile terminal may be provided on a surface of a housing portion with an antenna element and a piece of magnetic material, and may improve space efficiency thereby.

Figure 15:
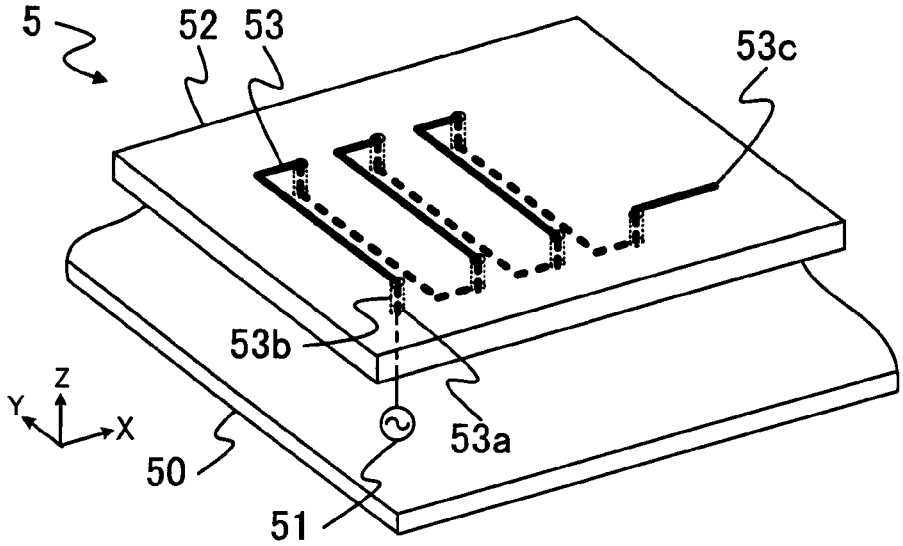
FIG. 15 shows a perspective view of a main portion of a wireless mobile terminal of a fifth embodiment of the present invention.
Figure 16:
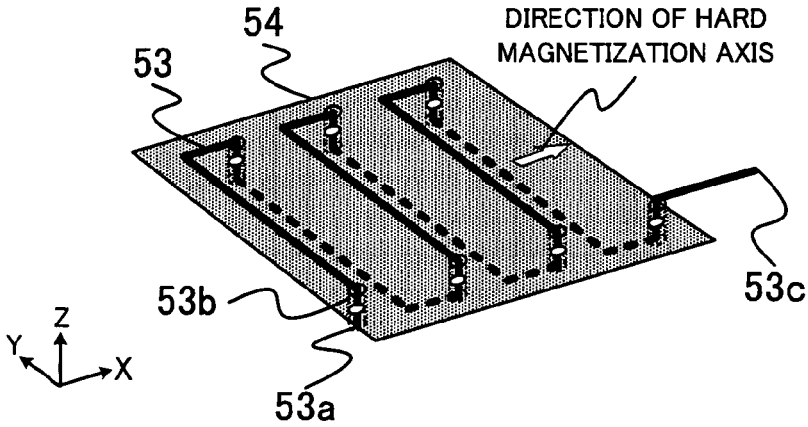
FIG. 16 shows a relative position between an antenna element and a piece of anisotropic magnetic material both included in an antenna component of the fifth embodiment.

A fifth embodiment of the present invention will be described with reference to FIG. 15 and FIG. 16. FIG. 15 shows a perspective view of a main portion of a wireless mobile terminal 5 of the fifth embodiment, indicating a configuration and a shape thereof. The wireless mobile terminal 5 has a printed circuit board 50 partially shown in FIG. 15. The printed circuit board 50 includes a feed portion 51. The wireless mobile terminal 5 has an antenna component 52. For convenience of explanation, an orthogonal coordinate system is defined as shown in FIG. 15.

The antenna component 52 is formed plate-like and includes an antenna element and anisotropic magnetic material. The antenna component 52 is, like the antenna component 29 of the fourth embodiment, formed by a plate-like piece of dielectric material, a plane-shaped piece of anisotropic magnetic material and a conductive layer for an antenna element, which are arranged in layers.

The antenna component 52 may be formed by a portion of a housing of the wireless mobile terminal 5 (not shown as a whole) provided with the antenna element and the anisotropic magnetic material, as described with respect to a first half of the fourth embodiment. A relative position between the anisotropic magnetic material and the antenna element will be shown later in FIG. 16.

The antenna component 52 is provided with a conductive pattern going up and down between an upper face and a lower face of the antenna component 52, as shown in FIG. 15. The above conductive pattern forms an antenna element 53 being at least partially meander-shaped. The antenna element 53 has a feed end 53*a* coupled to the feed portion 51 through a connection material like, e.g., a spring pin connector.

The antenna element 53 starts from the feed end 53*a*, goes up and down between the upper face and the lower face of the antenna component 52 through plural via holes including a via hole 53*b*, while being partially meander-shaped, and then reaches an open end 53*c*. In FIG. 15, portions of the antenna element 53 provided on the upper face and provided on the lower face and in the via holes are shown by solid lines and by dashed lines, respectively.

The orthogonal coordinate system defined in FIG. 15 has an X-axis being almost parallel to a face of the antenna component 52 and to a direction from the feed end 53*a* to the open end 53*c* of the antenna element 53. The orthogonal coordinate system has a Y-axis being almost parallel to the face of the antenna component 52 and perpendicular to the X-axis. The orthogonal coordinate system has a Z-axis being perpendicular to the X-axis and the Y-axis, and almost perpendicular to the face of the antenna component 52.

At least a portion of the antenna component 52 including the meander-shaped portion of the antenna element 53 is provided with a layer formed by a plane-shaped piece of anisotropic magnetic material 54 (not shown in FIG. 15). FIG. 16 shows a relative position between the antenna element 53 and the anisotropic magnetic material 54. Neither the portions of the antenna component 52 other than the antenna element 53 and the anisotropic magnetic material 54 nor the printed circuit board 50 are shown in FIG. 16. In FIG. 16, defined is a same orthogonal coordinate system as that defined in FIG. 15.

The antenna component 52 is provided with the anisotropic magnetic material 54, e.g., in such a manner as shown in one of FIGS. 9-11. At least a portion of the anisotropic magnetic material 54 is arranged in such a way as to direct an axis of hard magnetization almost parallel to the X-axis as shown in FIG. 16.

Assume, e.g., that the antenna element 53 works as a one-fourth wavelength monopole antenna. Antenna currents may be distributed on one segment and on a next segment of the antenna element 53 which are neighboring to each other, both parallel to the Y—and provided on the upper face and on the lower face, respectively, of the antenna component 52. The above antenna currents are spatially directed in reverse to each other, and may cause a reduction of radiation efficiency of the antenna element 53 thereby.

The antenna component 52 of the fifth embodiment may be provided with the anisotropic magnetic material 54 between the above segments of the antenna element 53 in such a way as to direct the axis of hard magnetization almost perpendicular to those segments. The antenna component 52 may reduce mutual interaction via magnetic fields produced by and between the above antenna currents directed in reverse, so as to improve the radiation efficiency of the antenna element 53 thereby.

According to the fifth embodiment of the present invention described above, a meander-shaped antenna element formed on both upper and lower faces of an antenna component or of a housing portion may be provided with anisotropic magnetic material, and may improve radiation efficiency thereby.

Figure 17:
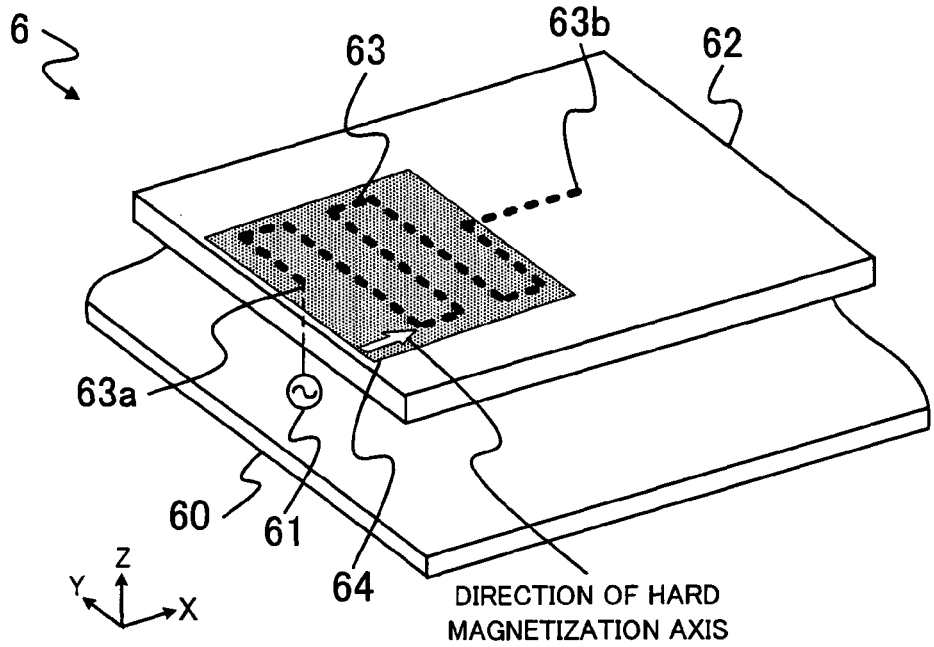
FIG. 17 shows a perspective view of a main portion of a wireless mobile terminal of a sixth embodiment of the present invention.

A sixth embodiment of the present invention will be described with reference to FIG. 17 and FIG. 18. FIG. 17 shows a perspective view of a main portion of a wireless mobile terminal 6 of the sixth embodiment, indicating a configuration and a shape thereof. The wireless mobile terminal 6 has a printed circuit board 60 partially shown in FIG. 17. The printed circuit board 60 includes a feed portion 61. The wireless mobile terminal 6 has an antenna component 62. For convenience of explanation, an orthogonal coordinate system is defined as shown in FIG. 17.

The antenna component 62 is formed plate-like and includes an antenna element and anisotropic magnetic material. The antenna component 62 is, like the antenna component 29 of the fourth embodiment, formed by a plate-like piece of dielectric material, a plane-shaped piece of anisotropic magnetic material and a conductive layer for an antenna element, which are arranged in layers.

The antenna component 62 may be formed by a portion of a housing of the wireless mobile terminal 6 (not shown as a whole) provided with the antenna element and the anisotropic magnetic material, as described with respect to the first half of the fourth embodiment.

The antenna component 62 is provided with a conductive pattern on a lower face of the antenna component 62, as shown in FIG. 17. The above conductive pattern forms an antenna element 63 being at least partially meander-shaped. The antenna element 63 has a feed end 63*a* coupled to the feed portion 61 through a connection material like, e.g., a spring pin connector.

The antenna element 63 is provided on the lower face of the antenna component 62 while being at least partially meander-shaped, and reaching an open end 63*b*. In FIG. 17, the antenna element 63 is indicated by a dashed line.

The orthogonal coordinate system defined in FIG. 17 has an X-axis being almost parallel to the face of the antenna component 62 and to a direction from the feed end 63*a* to the open end 63*b* of the antenna element 63. The orthogonal coordinate system has a Y-axis being almost parallel to the face of the antenna component 62 and perpendicular to the X-axis. The orthogonal coordinate system has a Z-axis being perpendicular to the X-axis and the Y-axis, and almost perpendicular to the face of the antenna component 62.

At least a portion of the antenna component 62 including the meander-shaped portion of the antenna element 63 is provided with a layer formed by a plane-shaped piece of anisotropic magnetic material 64. The anisotropic magnetic material 64 is arranged so as to isolate the antenna element 63 from another antenna element (not shown) provided on the upper face of the antenna component 62, or vice versa.

The antenna element 63 is provided to the antenna component 62, e.g., in a same way as the first portion 22*d* of the fourth embodiment is provided as shown in one of FIGS. 9-11. That is, the antenna element 63 is provided on a side of the anisotropic magnetic material 64 facing the printed circuit board 60. At least a portion of the anisotropic magnetic material 64 is arranged in such a way as to direct the axis of hard magnetization almost parallel to the X-axis as shown in FIG. 17.

Assume, e.g., that the antenna element 63 works as a one-fourth wavelength monopole antenna. Antenna currents may be distributed on one segment and on a next segment of the antenna element 63 which are neighboring to each other and both parallel to the Y-axis. As the above antenna currents are spatially directed in reverse to each other, those portions parallel to the Y-axis may make relatively smaller contribution to radiation.

As antenna currents distributed on segments of the antenna element 63 which are parallel to the X-axis are, however, spatially directed in a same direction, those segments parallel to the X-axis may make relatively greater contribution to radiation. The antenna currents distributed on the segments of the antenna element 63 which are parallel to the X-axis may produce a magnetic field which is almost parallel to the Y-axis.

As relative magnetic permeability of the anisotropic magnetic material 64 is small in a direction of the Y-axis, the above magnetic field may not so much be blocked by the anisotropic magnetic material 64. The wireless mobile terminal 6 may direct a radiation pattern upwards, i.e., in an opposite direction against the printed circuit board 60 in FIG. 17 thereby.

Figure 18:
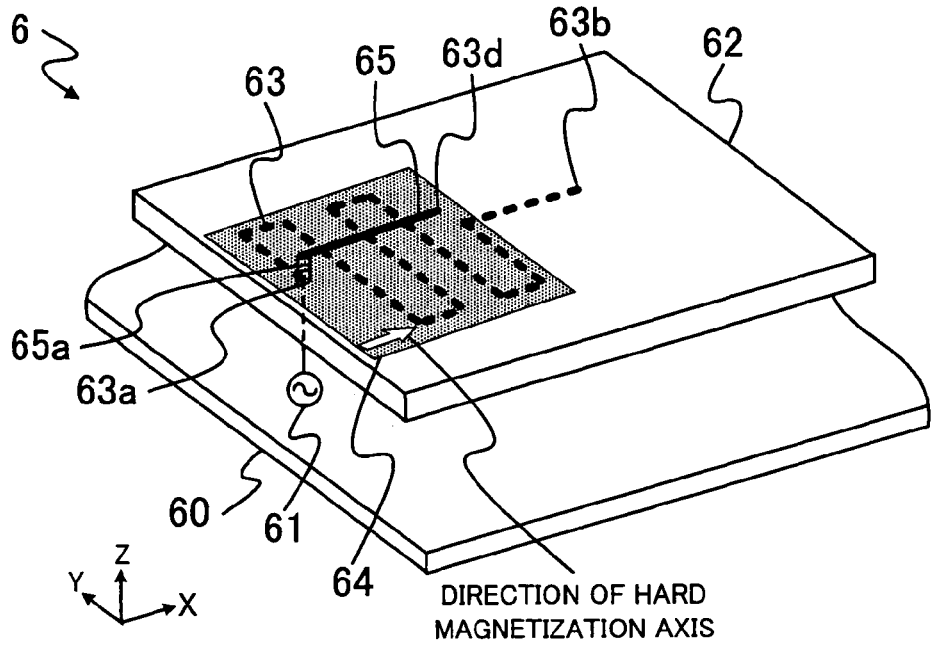
FIG. 18 shows a modification of the sixth embodiment, in which another antenna element is further provided.

FIG. 18 shows a modification of the sixth embodiment, in which the antenna component 62 shown in FIG. 17 is further provided with another antenna element 65 on the upper face of the antenna component 62. The antenna element 65 is provided almost in parallel to the X-axis. The antenna element 65 is coupled to the feed end 63*a* through a via hole 65*a* penetrating between the upper face and the lower face of the antenna component 62. Each of other portions shown in FIG.

18 is a same as the corresponding one given the same reference numeral shown in FIG. 17.

The antenna element 63 and the antenna element 65 may be thought as one branched antenna element. This configuration is similar to the configuration of the fourth embodiment shown in FIG. 9, where the segment of the first portion 22*d* of the antenna element 22 which is not covered by the magnetic material 13 may contribute to the radiation pattern at the lower resonant frequency. In FIG. 18, not only a portion of the antenna element 63 which is not covered by the anisotropic magnetic material 64, but also a segment of the meander-shaped portion of the antenna element 63 covered by the anisotropic magnetic material 64 but being parallel to the X-axis, may contribute to the radiation pattern formed at the lower resonant frequency.

According to the sixth embodiment of the present invention described above, a meander-shaped antenna element formed on a face of an antenna component or of a housing portion facing a printed circuit board may be provided with anisotropic magnetic material, and may effectively form a radiation pattern in an opposite direction against the printed circuit board.

Figure 19:
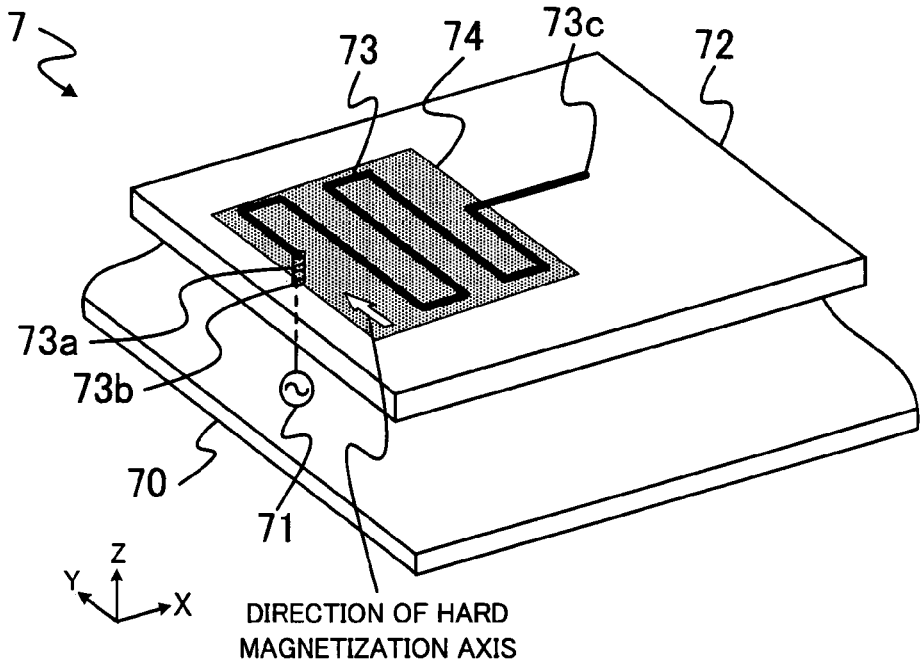
FIG. 19 shows a perspective view of a main portion of a wireless mobile terminal of a seventh embodiment of the present invention.

A seventh embodiment of the present invention will be described with reference to FIG. 19, which shows a perspective view of a main portion of a wireless mobile terminal 7 of the seventh embodiment, indicating a configuration and a shape thereof. The wireless mobile terminal 7 has a printed circuit board 70 partially shown in FIG. 19. The printed circuit board 70 includes a feed portion 71. The wireless mobile terminal 7 has an antenna component 72. For convenience of explanation, an orthogonal coordinate system is defined as shown in FIG. 19.

The antenna component 72 is formed plate-like and includes an antenna element and anisotropic magnetic material. The antenna component 72 is, like the antenna component 29 of the fourth embodiment, formed by a plate-like piece of dielectric material, a plane-shaped piece of anisotropic magnetic material and a conductive layer for an antenna element, which are arranged in layers.

The antenna component 72 may be formed by a portion of a housing of the wireless mobile terminal 7 (not shown as a whole) provided with the antenna element and the anisotropic magnetic material, as described with respect to the first half of the fourth embodiment.

The antenna component 72 is provided with a conductive pattern on an upper face of the antenna component 72, forming an antenna element 73. One end of the antenna element 73 is coupled through a via hole 73*a* to a feed end 73*b* provided on a lower face of the antenna component 72. The feed end 73*b* is coupled to the feed portion 71 through a connection material like, e.g., a spring pin connector.

The antenna element 73 is provided on the upper face of the antenna component 72 while being at least partially meander-shaped, and reaching an open end 73*c*. In FIG. 19, the antenna element 73 is indicated by a solid line.

The orthogonal coordinate system defined in FIG. 19 has an X-axis being almost parallel to the face of the antenna component 72 and to a direction from the feed end 73*b* to the open end 73*c* of the antenna element 73. The orthogonal coordinate system has a Y-axis being almost parallel to the face of the antenna component 72 and perpendicular to the X-axis. The orthogonal coordinate system has a Z-axis being perpendicular to the X-axis and the Y-axis, and almost perpendicular to the face of the antenna component 72.

At least a portion of the antenna component 72 including the meander-shaped portion of the antenna element 73 is provided with a layer formed by a plane-shaped piece of anisotropic magnetic material 74.

The antenna element 73 is provided to the antenna component 72, e.g., in a same way as the second portion 22*e* of the fourth embodiment is provided as shown in one of FIGS. 9-11. That is, the antenna element 73 is provided on an opposite side of the anisotropic magnetic material 74 against the printed circuit board 70. At least a portion of the anisotropic magnetic material 74 is arranged in such a way as to direct the axis of hard magnetization almost parallel to the Y-axis as shown in FIG. 19.

Assume, e.g., that the antenna element 73 works as a one-fourth wavelength monopole antenna. Antenna currents may be distributed on one segment and on a next segment of the antenna element 73 which are neighboring to each other and both parallel to the Y-axis. As the above antenna currents are spatially directed in reverse to each other, those segments parallel to the Y-axis may make relatively smaller contribution to radiation.

As antenna currents distributed on segments of the antenna element 73 which are parallel to the X-axis are, however, spatially directed in a same direction, those portions parallel to the X-axis may make relatively greater contribution to radiation. On a ground circuit of the printed circuit board 70, however, a current may be distributed in reverse and may cancel out the above antenna currents distributed on the segments of the antenna element 73 parallel to the X-axis, and the electromagnetic radiation may be reduced thereby.

As the anisotropic magnetic material 74 has the axis of hard magnetization and a high magnetic permeability in a direction of the Y-axis which is almost perpendicular to the direction of the antenna currents distributed spatially in a same direction, mutual interaction via a magnetic field between the segments of the antenna element 73 being almost parallel to the X-axis and the ground circuit of the printed circuit board 70 may be reduced. The antenna element 73 may improve radiation efficiency thereby.

According to the seventh embodiment of the present invention described above, a meander-shaped antenna element formed on an opposite side of an antenna component or of a housing portion against a printed circuit board may be provided with anisotropic magnetic material. The antenna element may keep radiation efficiency from being affected by a current distributed on the printed circuit board and being reduced thereby.

An eighth embodiment of the present invention will be described with reference to FIG. 20. The eighth embodiment will describe composition of the anisotropic magnetic material of the previous embodiments of the present invention.

Ordinary magnetic material of high permeability is formed by metal or alloy including Fe, Co or their oxide as constituents. At a higher frequency, transmission loss of the ordinary magnetic material caused by eddy currents tends to be greater, and it tends to be more difficult to use the ordinary magnetic material as base material thereby.

Accordingly, needed is non-conductive material of high permeability having transmission loss as small as possible, which may be used as base material in a higher frequency range.

As one of trials to provide such material of high permeability, nano-granular material of high permeability has been provided by using thin film technologies like a sputtering method. It has been confirmed that the nano-granular material has an excellent feature in the higher frequency range.

Such material of high permeability may be used as the anisotropic magnetic material of the previous embodiments.

A piece of such material of high permeability includes a base material portion and a composite magnetic membrane formed on the base material portion.

The composite magnetic membrane includes plural pillar-shaped elements and at least one inorganic insulator formed among the pillar-shaped elements.

The pillar-shaped elements contain magnetic metal or magnetic alloy selected from at least one of Fe, Co, and Ni. The pillar-shaped elements are formed by being overlaid on the base material portion in a manner where a longer dimension is directed perpendicular to a surface of the base material portion.

The inorganic insulator is selected from at least one of an oxide, a nitride, a carbide and a fluoride of metal. The composite magnetic membrane has magnetic anisotropy in a direction parallel with, or included in, the surface of the base material portion.

Figure 20:
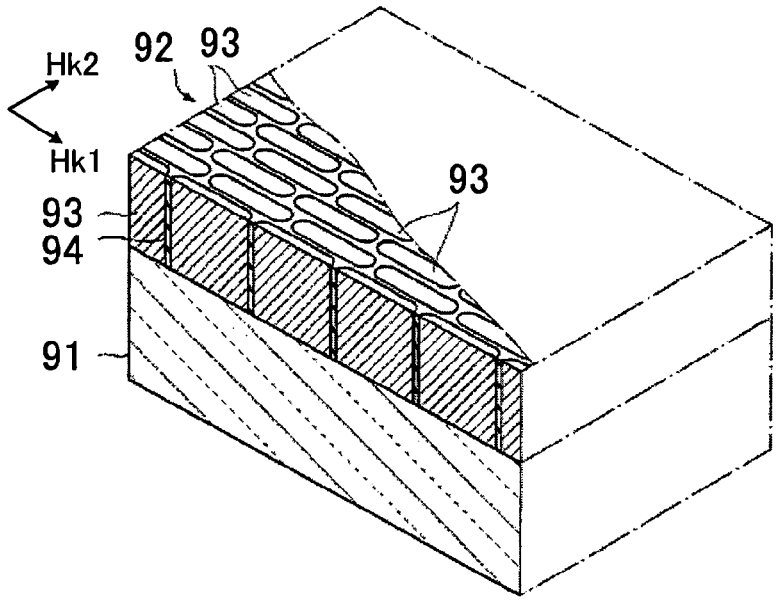
FIG. 20 shows composition of anisotropic magnetic material of an eighth embodiment of the present invention.

The above material of high permeability includes, e.g., a base material portion 91 as shown in FIG. 20. On a surface of the base material portion 91, formed is a composite magnetic membrane 92. The base material portion 91 is made of, e.g., plastic like polyimide or inorganic material like silicon oxide, alumina, MgO, Si, glass.

The composite magnetic membrane 92 includes a plurality of pillar-shaped component 93's on a surface of the base material portion 91. The pillar-shaped component 93 has a longer dimension oriented perpendicular to the surface of the base material portion 91. The pillar-shaped component 93 contains magnetic metal or magnetic alloy selected from at least one of Fe, Co, and Ni. In FIG. 20, shown is an example of the pillar-shaped component 93 having a longer dimension in a vertical direction and an elliptic section perpendicular to the longer dimension.

Among a plurality of the pillar-shaped component 93's, formed is at least one inorganic insulator 94 selected from at least one of an oxide, a nitride, a carbide or a fluoride of metal. The composite magnetic membrane 92 has magnetic anisotropy in a surface in parallel with the surface of the base material portion 91.

The composite magnetic membrane 92 has an anisotropic magnetic field Hk1 in the surface in parallel with the surface of the base material portion 91, and an anisotropic magnetic field Hk2 in parallel with the surface of the base material portion 91 and perpendicular to the anisotropic magnetic field Hk1. The composite magnetic membrane 92 has magnetic anisotropy where a ratio of these anisotropic magnetic fields (Hk2/Hk1) is no less than one. These anisotropic magnetic fields Hk1, Hk2 are shown in FIG. 20.

The above notation Hk represents a value of a magnetic field at an intersection point of following two tangents of a magnetization curve in a first quadrant (magnetization>0, applied magnetic field>0) where the magnetic field is applied in the surface of the composite magnetic membrane 92. One of the two tangents is at a value of the magnetic field where a variation of the magnetization with the applied magnetic field is greatest (i.e., where the magnetization is almost zero). Another one of the two tangents is at a value of the magnetic field where the variation of the magnetization with the applied magnetic field is smallest (i.e., where the magnetization is completely saturated).

According to the eighth embodiment of the present invention described above, a piece of magnetic material including pillar-shaped elements and a composite magnetic membrane may be provided. The pillar-shaped elements are made of magnetic metal or magnetic alloy, and have a high volume percentage. The composite magnetic membrane has a large ratio of a real part (μ') to an imaginary part (μ") of permeability (μ'/μ"). According to the eighth embodiment, an antenna device including an antenna printed board containing the magnetic material may also be provided.

The particular hardware or software implementation of the present invention may be varied while still remaining within the scope of the present invention. It is therefore to be understood that within the scope of the appended claims and their equivalents, the invention may be practiced otherwise than as specifically described herein.

What is claimed is:

1. An antenna device, comprising:

an antenna element including a first portion and a second portion which are joined to each other, the first portion and the second portion being substantially parallel to each other; and a plane-shaped piece of magnetized material provided between the first portion and the second portion.

2. The antenna device of claim 1, wherein the first portion of the antenna element has a path length that is longer than a path length of the second portion of the antenna element, and the magnetized material is arranged so as to isolate the second portion from the first portion.

3. The antenna device of claim 1, wherein the magnetized material has magnetic anisotropy with a uniquely defined axis of hard magnetization, and the magnetized material is arranged so that the axis of hard magnetization is directed substantially perpendicularly to one of the first portion and the second portion.

4. The antenna device of claim 2, wherein the magnetized material has magnetic anisotropy with a uniquely defined axis of hard magnetization, and the magnetized material is arranged so that the axis of hard magnetization is directed substantially perpendicularly to one of the first portion and the second portion.

5. The antenna device of claim 1, wherein the magnetized material is arranged to be substantially parallel to the first portion and the second portion.

6. A wireless mobile terminal, comprising:

a printed circuit board;

an antenna element including a first portion and a second portion which are joined to each other, the first portion and the second portion being substantially parallel to each other, and each of the first portion and the second portion being arranged to be substantially parallel to the printed circuit board; and a plane-shaped piece of magnetized material provided between the first portion and the second portion, the magnetized material being arranged to be substantially parallel to the printed circuit board.

7. The wireless mobile terminal of claim 6, wherein the first portion of the antenna element has a path length that is longer than a path length of the second portion of the antenna element, and the magnetized material is placed so as to isolate the second portion from the first portion.

8. The wireless mobile terminal of claim 6, wherein the first portion of the antenna element has a path length that is longer than a path length of the second portion of the antenna element, the first portion is arranged closer to the printed circuit board than the second portion is, and the magnetized material is arranged so as to isolate the second portion from the first portion.

9. The wireless mobile terminal of claim 6, wherein the magnetized material has magnetic anisotropy with a uniquely defined axis of hard magnetization, and the magnetized material is arranged so that the axis of hard magnetization is directed substantially perpendicularly to one of the first portion and the second portion.

10. The wireless mobile terminal of claim 7, wherein the magnetized material has magnetic anisotropy with a uniquely defined axis of hard magnetization, and the magnetized material is arranged so that the axis of hard magnetization is directed substantially perpendicularly to one of the first portion and the second portion.

11. The wireless mobile terminal of claim 8, wherein the magnetized material has magnetic anisotropy with a uniquely defined axis of hard magnetization, and the magnetized material is arranged so that the axis of hard magnetization is directed substantially perpendicularly to one of the first portion and the second portion.

12. The wireless mobile terminal of claim 9, wherein the magnetic material includes a base material portion and a composite magnetic membrane formed on the base material portion, wherein the composite magnetic membrane includes a plurality of pillar-shaped elements containing one of magnetic metal and magnetic alloy comprising at least one of Fe, Co and Ni, wherein the pillar-shaped elements are formed by being overlaid on the base material portion such that a longer dimension of the pillar-shaped elements is directed perpendicularly to a surface of the base material portion, wherein the composite magnetic membrane includes at least one inorganic insulator formed among the pillar-shaped elements, the inorganic insulator comprising at least one of an oxide, a nitride, a carbide and a fluoride of metal, and wherein the magnetic material has a ratio of a maximum magnetic field in a plane parallel to a surface of the base material portion Hk2 to a minimum magnetic field in the plane Hk1 denoted by Hk2/Hk1 that is greater than one.

13. The wireless mobile terminal of claim 10, wherein the magnetic material includes a base material portion and a composite magnetic membrane formed on the base material portion, wherein the composite magnetic membrane includes a plurality of pillar-shaped elements containing one of magnetic metal and magnetic alloy comprising at least one of Fe, Co and Ni, wherein the pillar-shaped elements are formed by being overlaid on the base material portion such that a longer dimension of the pillar-shaped elements is directed perpendicularly to a surface of the base material portion, wherein the composite magnetic membrane includes at least one inorganic insulator formed among the pillar-shaped elements, the inorganic insulator comprising at least one of an oxide, a nitride, a carbide and a fluoride of metal, and wherein the magnetic material has a ratio of a maximum magnetic field in a plane parallel to a surface of the base material portion Hk2 to a minimum magnetic field in the plane Hk1 denoted by Hk2/Hk1 that is greater than one.

14. The wireless mobile terminal of claim 6, wherein the magnetized material is arranged to be substantially parallel to the first portion and the second portion.

15. A wireless mobile terminal, comprising:

a printed circuit board;

only one plane-shaped and single-layered piece of anisotropic magnetic material having a uniquely defined axis of hard magnetization, the anisotropic magnetic material being arranged to be substantially parallel to the printed circuit board; and an antenna element including a meander-shaped portion, the antenna element being provided on at least one side of the anisotropic magnetic material.

16. The wireless mobile terminal of claim 15, wherein the portion of the antenna element is meander-shaped such that a segment of the portion provided on one side of the anisotropic magnetic material is coupled to a segment of the portion provided on another side of the anisotropic magnetic material in a repeated manner, and wherein the magnetic material is arranged so that the axis of hard magnetization is directed substantially parallel to a direction from one end to another end of the antenna element.

17. The wireless mobile terminal of claim 15, wherein the antenna element is arranged on a side of the anisotropic magnetic material facing the printed circuit board, and the magnetic material is arranged so that the axis of hard magnetization is directed substantially parallel to a direction from one end to another end of the antenna element.

18. The wireless mobile terminal of claim 15, wherein the antenna element is arranged on an opposite side of the anisotropic magnetic material from the printed circuit board, and the magnetic material is arranged so that the axis of hard magnetization is directed substantially perpendicularly to a direction from one end to another end of the antenna element.

19. The wireless mobile terminal of claim 15, wherein the anisotropic magnetic material includes a base material portion and a composite magnetic membrane formed on the base material portion, wherein the composite magnetic membrane includes a plurality of pillar-shaped elements containing one of magnetic metal and magnetic alloy comprising at least one of Fe, Co and Ni, wherein the pillar-shaped elements are formed by being overlaid on the base material portion such that a longer dimension of the pillar-shaped elements is directed perpendicularly to a surface of the base material portion, wherein the composite magnetic membrane includes at least one inorganic insulator formed among the pillar-shaped elements, the inorganic insulator comprising at least one of an oxide, a nitride, a carbide and a fluoride of metal, and wherein the anisotropic magnetic material has a ratio of a maximum magnetic field in a plane parallel to a surface of the base material portion Hk2 to a minimum magnetic field in the plane Hk1 denoted by Hk2/Hk1 that is greater than one.

20. The wireless mobile terminal of claim 16, wherein the anisotropic magnetic material includes a base material portion and a composite magnetic membrane formed on the base material portion, wherein the composite magnetic membrane includes a plurality of pillar-shaped elements containing one of magnetic metal and magnetic alloy comprising at least one of Fe, Co and Ni, wherein the pillar-shaped elements are formed by being overlaid on the base material portion such that a longer dimension of the pillar-shaped elements is directed perpendicularly to a surface of the base material portion, wherein the composite magnetic membrane includes at least one inorganic insulator formed among the pillar-shaped elements, the inorganic insulator comprising at least one of an oxide, a nitride, a carbide and a fluoride of metal, and wherein the anisotropic magnetic material has a ratio of a maximum magnetic field in a plane parallel to a surface of the base material portion Hk2 to a minimum magnetic field in the plane Hk1 denoted by Hk2/Hk1 that is greater than one.

21. An antenna device, comprising:

an antenna element including a first portion and a second portion which are joined to each other, the first portion and the second portion being substantially parallel to each other; and a plane-shaped piece of non-conductive magnetic material provided between the first portion and the second portion.

22. A wireless mobile terminal, comprising:

a printed circuit board;

an antenna element including a first portion and a second portion which are joined to each other, the first portion and the second portion being substantially parallel to each other, and each of the first portion and the second portion being arranged to be substantially parallel to the printed circuit board; and a plane-shaped piece of non-conductive magnetic material provided between the first portion and the second portion, the non-conductive magnetic material being arranged to be substantially parallel to the printed circuit board.

* * * * *